United States Patent [19]

Catanese et al.

[11] 4,182,969

[45] Jan. 8, 1980

[54] ELECTRON MULTIPLIER DEVICE WITH SURFACE ION FEEDBACK

[75] Inventors: Carmen A. Catanese, Rocky Hill; John G. Endriz, Plainsboro, both of N.J.

[73] Assignee: RCA Corporation, New York, N.Y.

[21] Appl. No.: 671,558

[22] Filed: Mar. 29, 1976

[51] Int. Cl.[2] ..... H01J 43/10; H01J 43/20; H01J 31/08; H01J 39/06

[52] U.S. Cl. ..... 313/105 R; 313/400; 313/95

[58] Field of Search ..... 313/105 R, 104, 103 RM, 313/, 103 R, 165 R

[56] References Cited

U.S. PATENT DOCUMENTS

| | | | |
|---|---|---|---|
| 2,381,012 | 8/1945 | Stutsman | 313/104 X |
| 2,867,729 | 1/1959 | Morton et al. | 313/105 X |
| 3,229,143 | 1/1966 | Bartschat | 313/105 |
| 3,693,004 | 9/1972 | Sanford | 313/103 |
| 3,735,184 | 5/1973 | Maeda | 313/105 |
| 3,899,706 | 8/1975 | Ball | 313/105 |
| 3,904,923 | 9/1975 | Schwartz | 313/105 R X |
| 4,029,984 | 6/1977 | Endriz | 313/400 X |

*Primary Examiner*—Robert Segal

*Attorney, Agent, or Firm*—Glenn H. Bruestle; Dennis H. Irlbeck; George E. Haas

[57] ABSTRACT

The electron multiplier device is operable in a substantial vacuum and comprises a cathode which emits electrons upon ion bombardment and an electron multiplier section adjacent the cathode for multiplying electrons emitted from the cathode. An output target surface is partially interposed in the path of the electrons near the output of the multiplier. A portion of the electrons released by the multiplier strike the output target surface causing ions to be emitted therefrom. The ions then feed back and bombard the cathode causing it to release more electrons, which in turn are multiplied thereby providing a buildup of electrons leaving the multiplier output. The output electrons may be controlled by an electron control section aligned with the multiplier near its output end.

8 Claims, 6 Drawing Figures

Fig. 4.
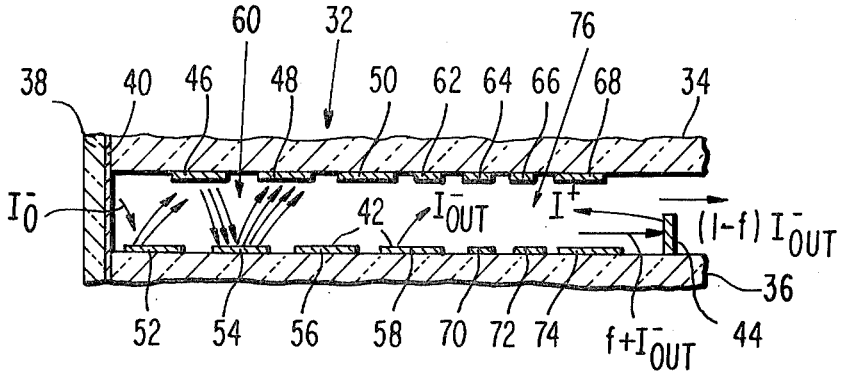
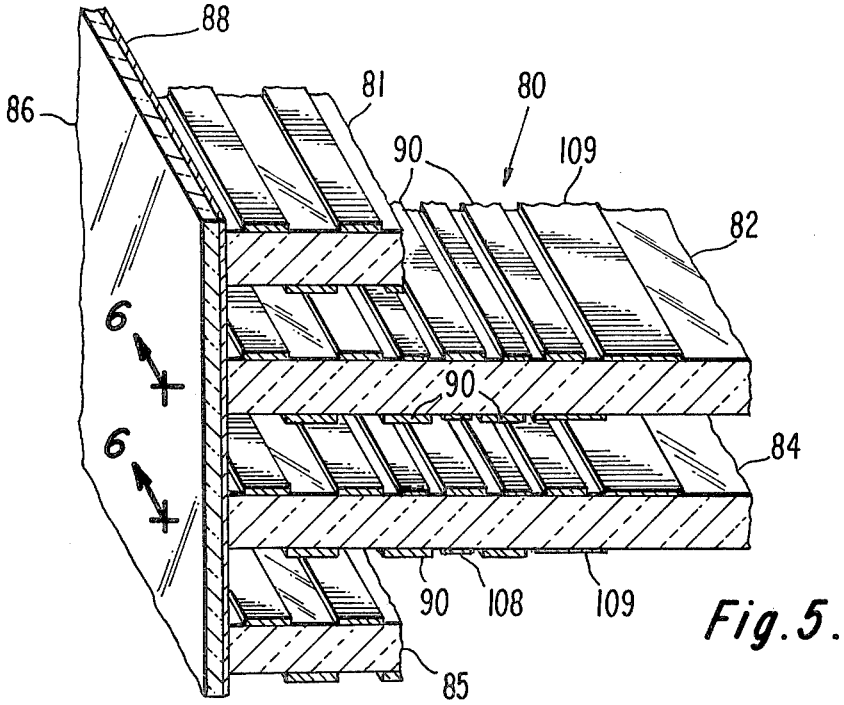
Fig. 5.
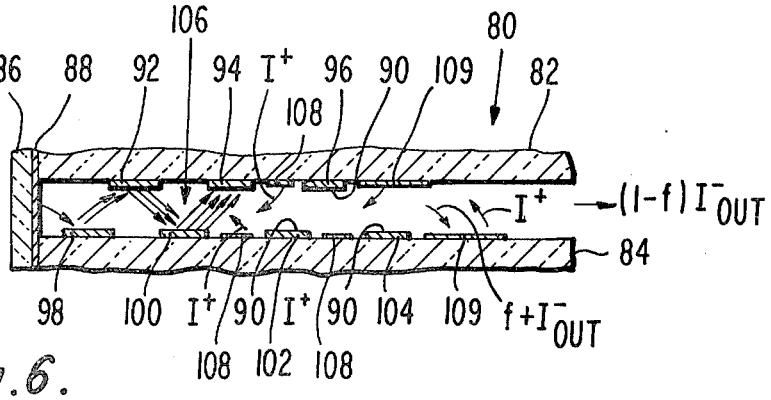
Fig. 6.

ELECTRON MULTIPLIER DEVICE WITH SURFACE ION FEEDBACK

BACKGROUND OF THE INVENTION

This invention relates to electron sources and particularly to an electron multiplier device operating in a substantial vacuum and incorporating surface ion feedback.

Flat panel display devices wherein an electron multiplier with gas ion feedback is used as an electron source for a cathodoluminescent display have been suggested. Feedback is in the form of a positive ion beam which is produced by the interaction of electrons striking atoms of a residual gas in the device. One disadvantage of this type of display device wherein a residual gas must be used, is that during operation, the gas atoms become buried in internal components of the device, such as when ions are buried in a feedback target, thereby diminishing the gas content within the device during normal operation. Therefore, there is a need for an electron source that utilizes the advantages of an electron multiplier having ion feedback but that does not require a gaseous atmosphere in which to operate.

SUMMARY OF THE INVENTION

An electron multiplier device operable in a substantial vacuum with surface ion feedback comprises a cathode for emitting electrons in response to ion bombardment, multiplying means adjacent the electrode means for multiplying the number of electrons emitted from the cathode, and surface target means interposed in a path of the multiplied electrons for releasing ions in response to electron bombardment which feed back toward the cathode.

BRIEF DESCRIPTION OF THE DRAWINGS

FIG. 4 is a sectional view of the electron multiplier device taken at lines 4—4 of FIG. 3.

FIG. 5 is a partial cutaway perspective view of yet another multiplier device constructed in accordance with the present invention.

FIG. 6 is a sectional view of the electron multiplier device taken at lines 6—6 of FIG. 5.

DETAILED DESCRIPTION

Figure 1:
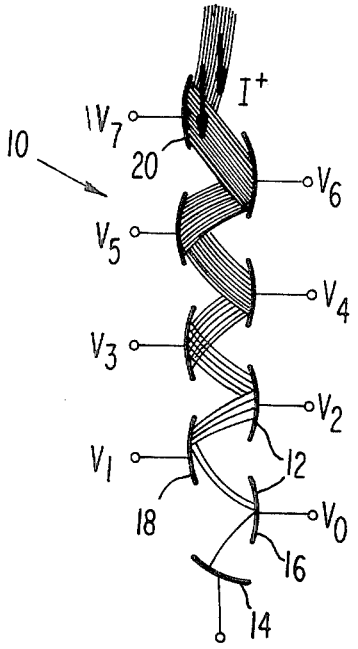
FIG. 1 is a schematic side view of a prior art electron multiplier device.

FIG. 1 shows one embodiment of a prior art electron multiplier 10. The multiplier 10 comprises a series of staggered plates or dynodes 12 spaced from a cathode 14. Each dynode 12 has a curved shape and is positioned to focus electrons emitted therefrom onto the surface of a succeeding dynode. The surfaces of the dynodes 12 are coated with high secondary-emissive material so that a greater number of electrons are emitted from the dynodes than strike them when appropriate voltages, designated $V_0$–$V_7$, are applied to the respective dynodes. Generally, operation of the multiplier 10 commences when an electron leaves the cathode 14 and strikes the first dynode 16 having $V_0$ applied to it. Collision of this electron with the first dynode 16, releases secondary electrons from the surface of the first dynode 16. Most of these secondary electrons strike a second dynode 18, which in turn, emits further secondary electrons. This sequence continues from dynode to dynode with each dynode 12 releasing more secondary electrons than strike it. Therefore, a buildup of electrons occurs within the multiplier 10 so that a large number of electrons leave the last dynode 20. Most of these electrons can be accelerated to perform a desired function beyond the output of the multiplier 10.

The prior art suggests operating the multiplier 10 in a gaseous atmosphere at a pressure below that which would sustain gas discharge. In such an atmosphere, some of the electrons strike residual gas molecules within the device thus forming positive gas ions $I^+$. These positive ions $I^+$ are accelerated by the dynode fields backward to collide with the cathode 14. Collision of the positive ions with the cathode 14 releases further electrons from the cathode 14 which in turn are also multiplied by the dynodes 12. When the gain of the total loop including the dynode gains, ionization and feedback efficiences and the cathode emission coefficient is greater than unity, the multiplier output will be self-sustaining.

Figure 2:
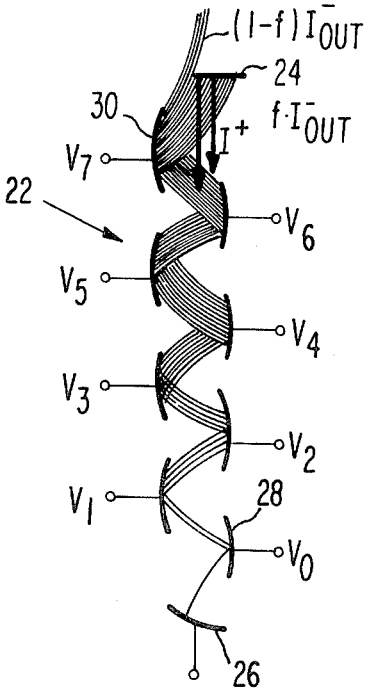
FIG. 2 is a schematic side view of an electron multiplier device constructed in accordance with the present invention.

A multidynode electron multiplier device 22, constructed in accordance with the present invention, is illustrated in FIG. 2. Basically, the structure of this multiplier device 22 is the same as the structure of the multiplier 10 of FIG. 1, with two notable exceptions. The first exception being that the device 22 is operable in a substantial vacuum, e.g. less than $10^{-6}$ torr, and the second being that a surface ion target 24 is interposed at the output end of the multiplier device 22. This target 24 blocks part of the electron path so that a portion of the electrons exiting the multiplier must strike the target 24. The electron current striking the target 24 is equal to $f \cdot I^-_{out}$, where $I^-_{out}$ is the electron current output from the multiplier dynodes. Thus $(1-f)I^-_{out}$ is the electron current that bypasses the target 24 to serve a desired function within an apparatus incorporating the multiplier device 22 therein.

The electrons that strike, or rather, bombard the target 24 cause positive ions to be released from the surface of the target 24. As in the prior art, these ions, represented as positive ion current $I^+$, are accelerated by the dynode fields back toward a cathode 26 of the multiplier device 22 where bombardment of the cathode 26 releases further electrons which are multiplied by the multiplier device 22.

In operation of the multiplier device 22, the initiating electron or electrons leaving the cathode 26 can be considered to form an initiating electron current, $I_o^-$. This current which may be caused by stray electrons released by cosmic bombardment or some other random event, is amplified when it strikes a first dynode 28. The current increases from dynode to dynode until a relatively large electron output current $I^-_{out}$ is attained at a last dynode 30. The value of the electron output current from the multiplier dynodes $I^-_{out}$ is given by the equation, $$I^-_{out} = MI^-_o$$

where M is the multiplier gain.

As previously noted, the electron current striking the target 24 is equal to $f \cdot I^-_{out}$. Therefore, the positive ion current $I^+$ generated at the target 24 is equal to, $$I^+ = \alpha f \cdot I^-_{out}$$

or substituting for $I^-_{out}$, $$I^+ = \alpha f M I_o^-$$

where $\alpha$ is the efficiency with which accelerated electrons produce surface ions that feed back to the cathode.

The positive ions emitted from the output target 24, accelerated by a strong field at the surface of the output target 24, enter the multiplier dynode area and are further accelerated as they pass through or alternately, feed back, through the multiplier device 22 with relatively little deflection. Ions striking the cathode 26 cause secondary electron emission with an efficiency $\gamma$, which is determined by the cathode material. As a result of this feedback and bombardment of the cathode 26, the new input current $I^-_o{}'$ that strikes the first dynode 28 from the cathode 26 of the multiplier 22 is given by the equation, $$I^-_o{}' = \alpha f \gamma M I^-_o.$$

If the quantity $\alpha f \gamma M$ is greater than unity, the current will increase during the next subsequent feedback cycle until some saturation mechanism; e.g. space charge current limiting, acts to stabilize it at some sustained, constant level.

Figure 3:
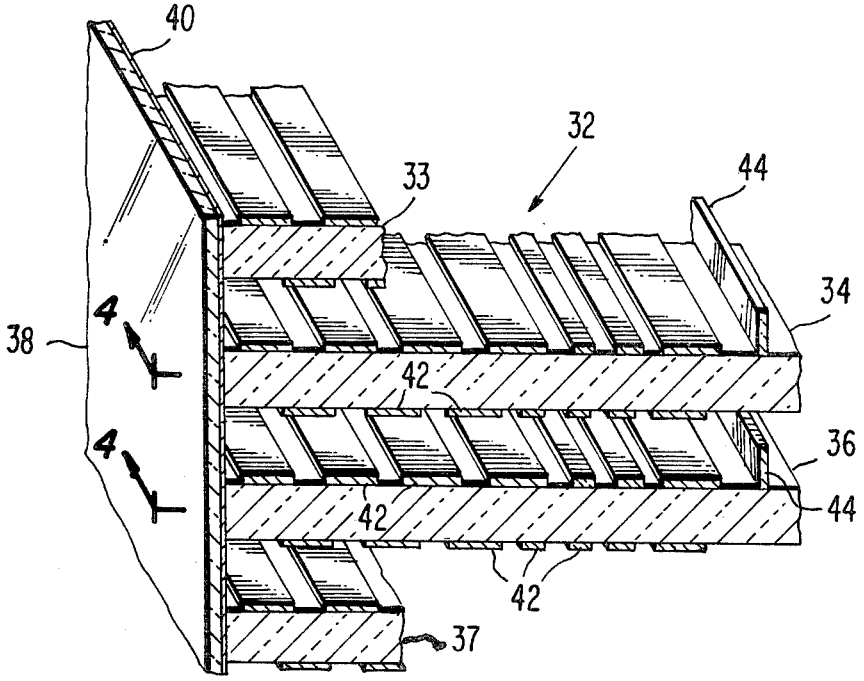
FIG. 3 is a partial cutaway perspective view of another electron multiplier device constructed in accordance with the present invention.

The inventive concept as described with respect to FIG. 2 will now be applied to more specific embodiments. FIGS. 3 and 4 show a portion of an electron multiplier device array 32 comprising spaced parallel plates 33, 34, 36 and 37 extending from a back wall or panel 38. The plates 33, 34, 36, and 37 are formed from an electrically insulative material such as glass or ceramic. The back panel 38 either may be a metal or an insulative material coated either with a metal layer on its interior side or with some other material 40 having high secondary emission characteristics. Each plate 33, 34, 36 and 37 has a pattern of conductive multiplier dynodes 42 thereon. These dynodes 42 are spaced from and parallel to each other. The dynodes 42 on one plate 34 are spaced from the cathode 40 at predetermined distances to cooperate with similarly spaced, but offset dynodes 42 on the facing side of the adjacent plate 36. Each dynode 42 is formed with a base comprising a conductive material which is overcoated with a material having good secondary emission characteristics, such as MgO.

Positioned at an output end of each multiplier of the array 32 is an output target 44 which partially closes the space between two adjacent plates 34 and 36. This output target 44 should be constructed of a material capable of emitting ions over a long period of time. For example, molybdenum and palladium are materials that meet this requirement.

The three dynodes 46, 48 and 50 on the bottom side of the plate 34 and the four dynodes 52, 54, 56 and 58 on the top side of the lower plate 36 comprise an electron multiplier 60. The remaining electrodes 62, 63, 66 and 68 on the bottom side of the plate 34 and the electrodes 70, 72 and 74 on the top side of the plate 36 constitute an extraction and control section 76 of the multiplier 60. The extraction and control section 76 is a low voltage region wherein electron flow is directed to an output of the device 32 and is controlled by adjusting the voltage on the electrodes 62, 64. . . 74.

An alternate embodiment of an electron multiplier device array 80 is shown in the partial views of FIGS. 5 and 6. This array 80 is similar to the array 32 of FIGS. 3 and 4 comprising spaced parallel plates 81, 82, 84 and 85 extending from a back panel 86 having a cathode 88 thereon. Each side of each plate has a dynode pattern 90 thereon. Referring now to the facing sides of plates 82 and 84, the three dynodes 92, 94 and 96 on the bottom side of the plate 82 and the four dynodes 98, 100, 102 and 104 on the top side of the plate 84 comprise a multidynode electron multiplier 106. No control section is included in array 80; however, it is to be understood that a control section could be located at an output of the multiplier 106. The output target in the array 80 is somewhat different than the target 44 of the array 32. In this embodiment, target pads 108 are interspersed between multiplier dynodes and an additional pad 109 is located at the multiplier output. The feedback method of this embodiment assumes that some percentage of the electrons from dynode-to-dynode and at the multiplier output will stray from a perfect dynode-to-dynode path and will strike adjacent to the dynodes. The pads 108 and 109, therefore, are positioned to receive these stray electrons. Again the pads 108 and 109 may be made of the same materials as are appropriate for the target 24. When struck by electrons, the pads 108 and 109 release positive ions which are accelerated back toward the cathode 88 as described with respect to the embodiment of FIG. 2.

We claim:

1. An electron multiplier device heating surface ion feedback comprising, cathode means for emitting electrons in response to ion bombardment, multiplying means adjacent said cathode means for multiplying the number of electrons emitted from said cathode means, and target means adjacent to and separate from said multiplying means, said target means being of a material capable of emitting ions back to said cathode means in response to electron bombardment from said cathode and multiplying means over a long period of time, said target means including a structure which at least partially blocks an output end of said multiplying means.

2. The electron multiplier device as defined in claim 1, including control means aligned with said multiplying means for limiting the passage of electrons therethrough.

3. An electron multiplier device in an evacuated enclosure having surface ion feedback comprising:

a cathode for emitting electrons in response to ion bombardment, a multidynode electron multiplier section adjacent said cathode for multiplying electrons emitted from said cathode, and separate target means adjacent to and partially blocking an output end of said electron multiplier section wherein at least a portion of said target means includes a material capable of emitting ions in response to electron bombardment over a long period of time, whereby ions emitted from said target feedback to said cathode to release additional electrons for multiplication.

4. The electron multiplier device as defined in claim 3 including an electron control section aligned with said multiplier for limiting the number of electrons leaving said multiplier section.

5. The electron multiplier device as defined in claim 4 wherein said material is selected from the group consisting of molybdenum or palladium.

6. An electron multiplier device having surface ion feedback which includes at least two spaced parallel insulating plates, comprising:

cathode means for emitting electrons in response to ion bombardment;

a multiplier section including a plurality of multiplier dynodes adjacent said cathode means for multipying the number of electrons emitted from said cathode means, said dynodes being disposed on facing surfaces of said insulating plates, and target means adjacent to and separate from said multiplying means, said target means being of a material capable of emitting ions back to said cathode means in response to electron bombardment from said cathode and multiplier dynodes over a long period of time.

7. The electron multiplier device as defined in claim 6 wherein said output target means comprises at least one target pad located between two dynodes of said multiplier section.

8. The electron multiplier device as defined in claim 7 including a plurality of target pads interspersed between said multiplier dynodes.

* * * * *

UNITED STATES PATENT AND TRADEMARK OFFICE
CERTIFICATE OF CORRECTION

PATENT NO. : 4,182,969

DATED : January 8, 1980

INVENTOR(S) : Carmen Anthony Catanese et al

It is certified that error appears in the above-identified patent and that said Letters Patent is hereby corrected as shown below:

| | | |
|---|---|---|
| Column 1, | line 61, | after "with" insert "a". |
| Column 3, | line 63, | change "63" to --64--. |
| Column 4, (Claim 1) | line 34 | the word "heating" should be "having". |
| FIGURE 1 | | should be labeled "PRIOR ART". |

Signed and Sealed this

*Thirtieth* Day of *September 1980*

[SEAL]

*Attest:*

SIDNEY A. DIAMOND

*Attesting Officer*

*Commissioner of Patents and Trademarks*